US005860729A

United States Patent [19]

Bamber

[11] Patent Number: 5,860,729

[45] Date of Patent: Jan. 19, 1999

[54] FLUORESCENT LANTERN WITH AUXILIARY LIGHT

[75] Inventor: David J. Bamber, Witchita, Kans.

[73] Assignee: The Coleman Company, Inc., Witchita, Kans.

[21] Appl. No.: 760,196

[22] Filed: Dec. 4, 1996

[51] Int. Cl.[6] ..... F21L 7/00

[52] U.S. Cl. ..... 362/184; 362/190; 362/251; 362/399

[58] Field of Search ..... 362/184, 185, 362/190, 200, 205, 208, 216, 228, 236, 249, 251, 260, 399

[56] References Cited

U.S. PATENT DOCUMENTS

| | | | |
|---|---|---|---|
| D. 280,027 | 8/1985 | Petterson | D26/40 |
| D. 311,777 | 10/1990 | Stearns | D26/42 |
| D. 342,800 | 12/1993 | Petterson et al. | D26/41 |
| D. 374,099 | 9/1996 | Bamber | D26/41 |
| 4,074,122 | 2/1978 | Moore | 362/200 |
| 4,249,234 | 2/1981 | Park et al. | 362/228 |
| 4,321,657 | 3/1982 | Hoi | 362/183 |
| 4,432,043 | 2/1984 | Yuen | 362/184 |
| 4,663,697 | 5/1987 | Stearns et al. | 362/184 |
| 4,771,370 | 9/1988 | Lowe, Jr. et al. | 362/216 |
| 4,782,432 | 11/1988 | Coffman | 362/184 |
| 4,787,018 | 11/1988 | Poyer | 362/216 |
| 5,192,126 | 3/1993 | Remeyer et al. | 362/184 |
| 5,217,297 | 6/1993 | Yuen | 362/184 |
| 5,293,306 | 3/1994 | Bamber | 362/186 |
| 5,446,340 | 8/1995 | Parillo et al. | 313/493 |
| 5,453,920 | 9/1995 | Eubanks | 362/376 |
| 5,588,738 | 12/1996 | Meoli | 362/184 |

OTHER PUBLICATIONS

REI Catalog, Spring, 1993, Item K, Bottom of p.18.

Coleman Catalog, 1994, Item #5350–701, Bottom of p. 115.

*Primary Examiner*—Stephen F. Husar

[57] ABSTRACT

A lantern includes a fluorescent tube light and an auxiliary incandescent light. The incandescent light is covered by a colored lens. A control knob operates a switch in electrical connection with an electric power source, the fluorescent tube light, and the incandescent light, with the control knob being operable between a "first" or off position in which both lights are off, a "second" position in which the incandescent light is on and the fluorescent light is off, and a "third" position in which the incandescent light is off and the fluorescent light is on.

8 Claims, 4 Drawing Sheets

FLUORESCENT LANTERN WITH AUXILIARY LIGHT

FIELD OF THE INVENTION

This invention relates generally to lanterns including a light source and a transparent globe surrounding the light source, and more particularly, to a lantern including a fluorescent light mounted on a light platform on a lantern base, with a lens over a portion of the light platform covering a second light bulb in the base, the entire light platform and fluorescent light being enclosed in a transparent globe.

DESCRIPTION OF THE PRIOR ART

It is a desirable feature for a flashlight or lantern to be provided with multiple light sources. For example, it is known that a single flashlight may have both an elongated fluorescent tube light in one direction, such as along one side of the flashlight, and an incandescent light in another direction, such as at the end of the flashlight. Different combinations of lights are possible. It is understood, for example, that a fluorescent tube light has been used together with multiple colored lights in a single flashlight body so that the flashlight can be used for normal fluorescent illumination, or as a beacon in an emergency.

There have also been attempts to provide multiple light source flashlights with at least one light source pointing in variable directions, for example by mounting a first light bulb in an end of a flashlight body, and a fluorescent tube light in a movable handle portion of the same flashlight body. These and other embodiments of multi-light source flashlights meet certain needs of users, such as illuminating a large area such as a campsite using the fluorescent light, and directionally lighting a smaller area using the light bulb.

U.S. Pat. No. 5,293,306 describes a lantern having fluorescent tube lights and a shutter that can be closed to partially block light from the fluorescent tubes so that the lantern can operate with either a lateral exposure of 360° when the shutter is open, or less than 360° when the shutter is closed. However, the lantern does not provide a light source dim enough to provide only a low level of light to illuminate a small area such as the inside of a tent. Even when the shutter is in the closed position, the lantern is too bright for such uses.

SUMMARY OF THE INVENTION

The present invention provides a lantern having a dual light source which is capable of operating both as a fluorescent tube light with lateral exposure of 360° of fluorescent light and as a night light. The invention also provides the lantern with a single switch capable of operating between a position in which both the fluorescent tube light and the night light are off; a position in which the fluorescent tube light is on and the night light is off; and a position in which the night light is on and the fluorescent light is off. If desired, the switch could also operate in a position in which both the fluorescent light and the night light are on.

In the combination lantern of the present invention, the night light is provided in the portion of the lantern that provides the base for the fluorescent tube light. It is recognized that the portion of the base that houses the night light can be covered with a colored lens so that light emitted from the night light is the color of the colored lens. These and other advantages of the present invention will become clear by reference to the drawing figures, the detailed description of the preferred embodiment, and the appended claims.

DETAILED DESCRIPTION OF THE PREFERRED EMBODIMENT

Figure 1:
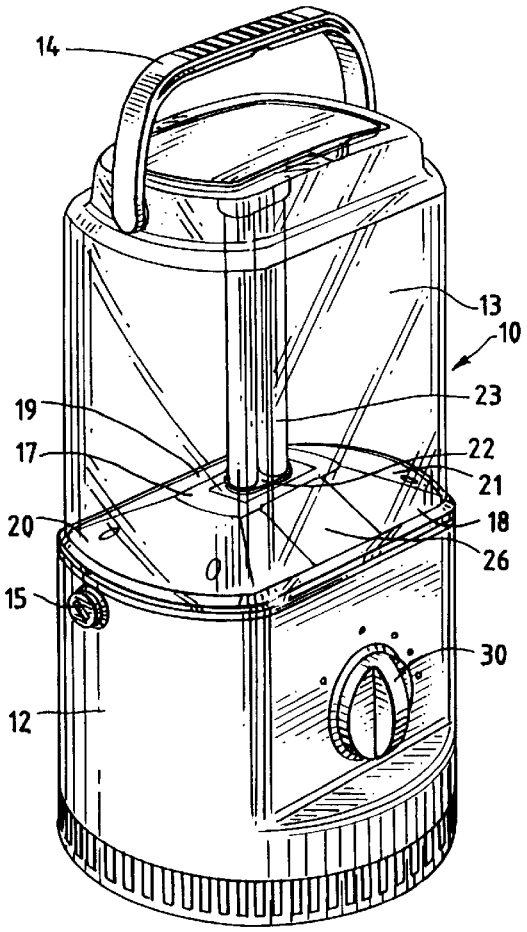
FIG. 1 is a perspective view of the combination lantern of the present invention having a fluorescent tube light and a night light.
Figure 2:
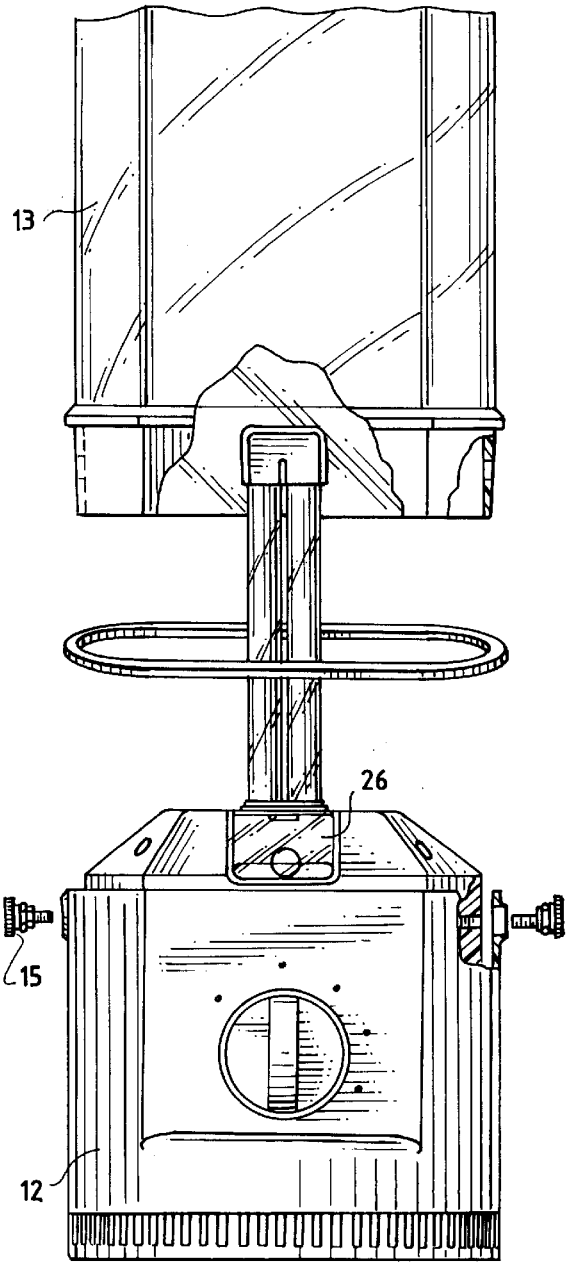
FIG. 2 is a fragmentary front view of the present invention with the globe removed showing a fluorescent tube light and a night light.
Figure 3:
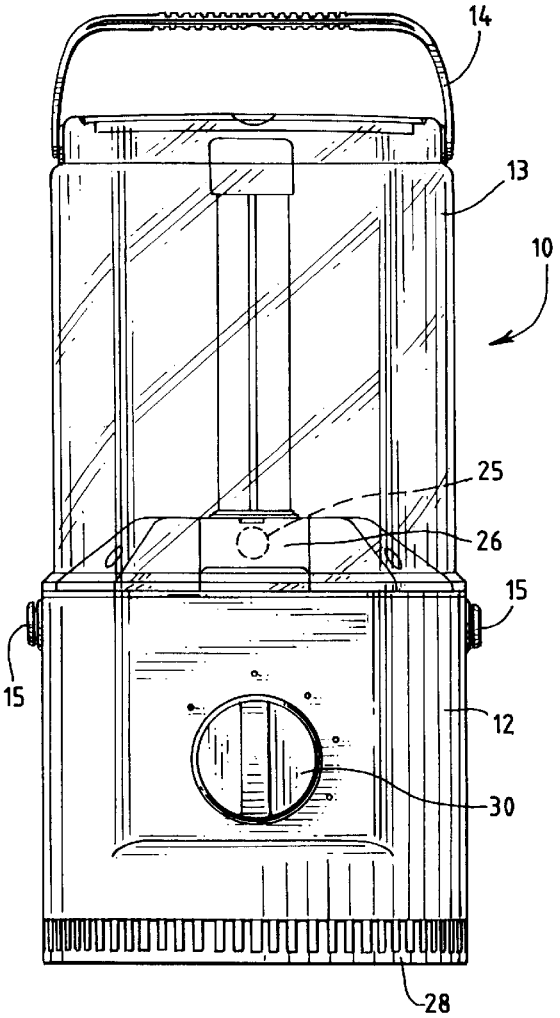
FIG. 3 is a front view of the present invention.
Figure 4:
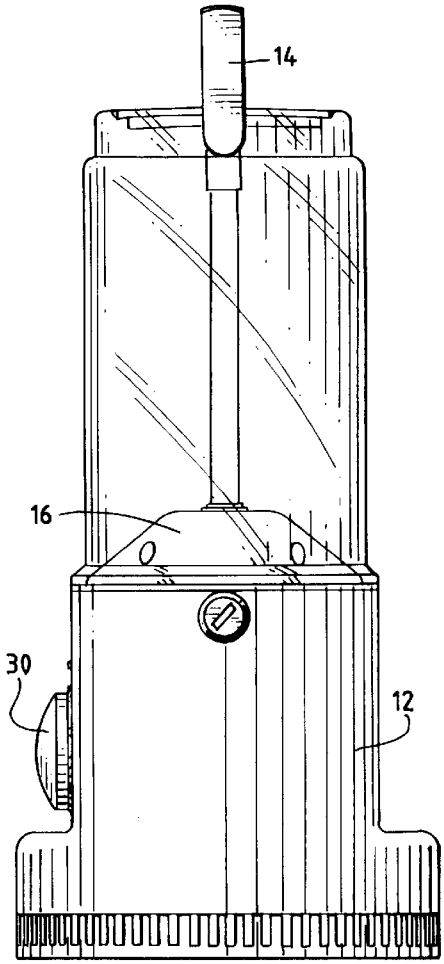
FIG. 4 is a right side view of the present invention.
Figure 5:
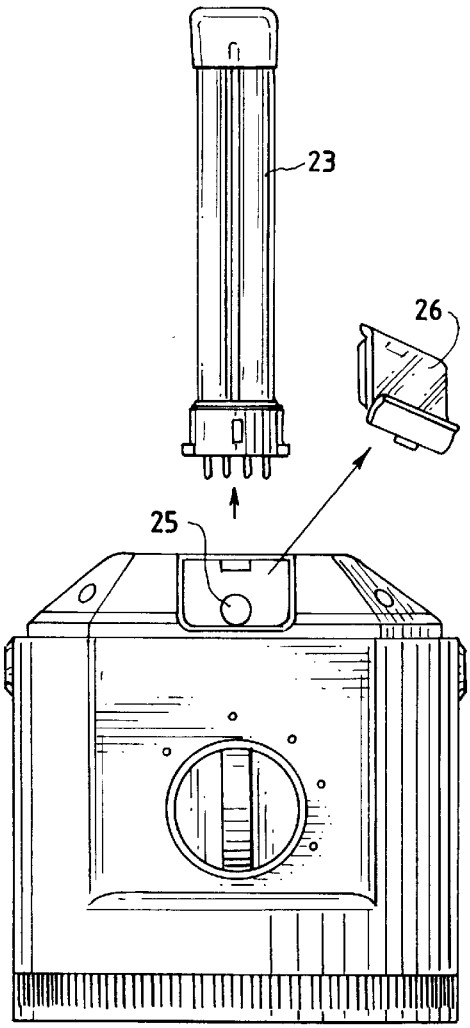
FIG. 5 is a partial front view of the combination lantern of the present invention showing the fluorescent tube light removed from its socket and the cover of the night light removed.

As shown in Drawing FIGS. 1–6, a lantern 10 includes a base 12, a transparent dome 13 that is mounted on the base 12, and a generally U-shaped handle 14 which is pivotally mounted to the top of the dome 13. When it is desired to carry the lantern by the handle 14, a user can place the handle in its upright position as shown in the drawings. When the handle is not in use, it can be pivoted downwardly so that it extends around top of the dome. The dome is releasably secured to the base by screws 15.

The base 12 includes a top wall 16 which includes a central flat top panel 17 and angled side panels 18, 19, 20, and 21 which extend outwardly and downwardly from the central top panel 17. A socket 22 is mounted in the top panel 17. In the particular embodiment illustrated, a commercially available U-shaped fluorescent tube light 23 is plugged into the socket. However, other types of light sources can also be used. An incandescent light bulb 25 is mounted below the angled panel 18, and a transparent lens 26 is mounted in the panel 18 above the bulb 25.

The lens 26 is advantageously colored or tinted so that light from the bulb 25 which passes through the light is colored. For example, a yellow lens can be used so that the bulb 25 can be used as a night light. Alternatively, a clear lens and a colored light bulb can be used. Advantageously, the angled side panel 18 in which the lens 26 is mounted facilitates projecting a wide angle of light from the night light, whereas if the lens 26 was horizontal or vertical, not as much area would be illuminated by the night light. The color or tint of the lens imparts a dimming effect to light emitted from the light bulb 25.

Figure 6:
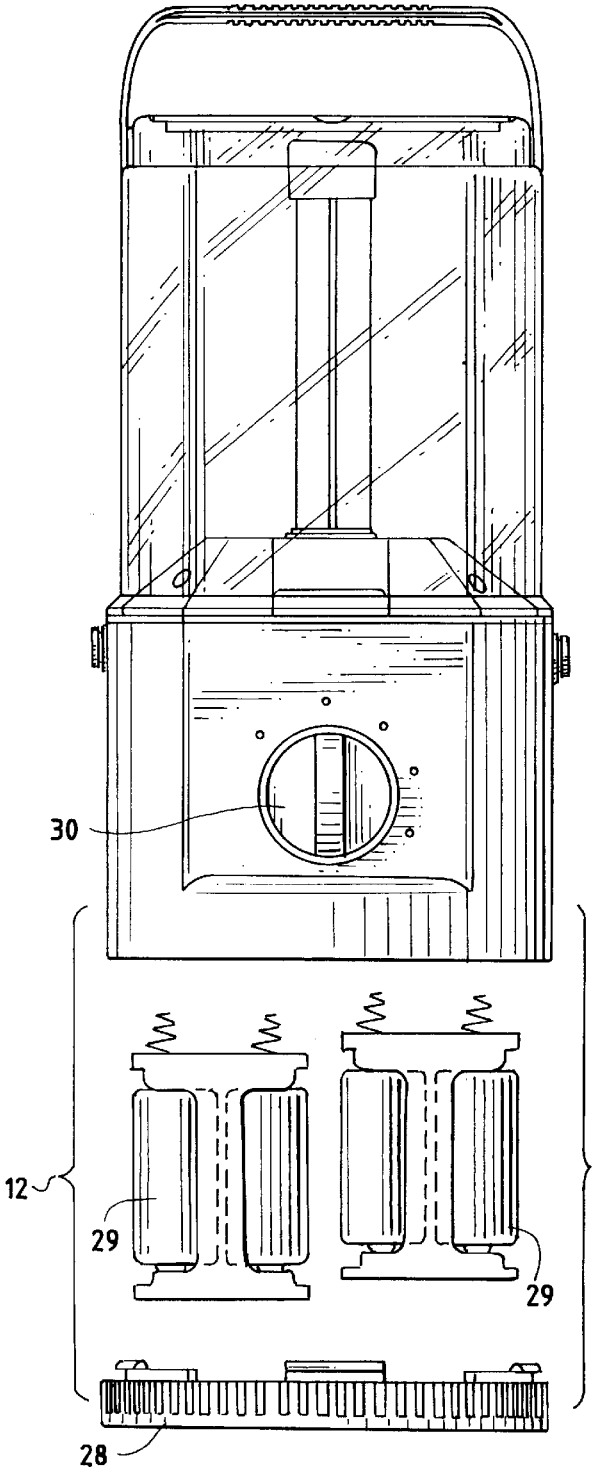
FIG. 6 is a fragmentary view of the combination lantern of the present invention showing the bottom of the lantern removed and showing two battery packs removed from the base.

Referring now to FIG. 6, the base 12 includes a removable bottom cap 28, and a source of electric power 29, for example, 8 D-size dry cell batteries providing 12 volts direct current (VDC) mounted within the base. A control knob 30 is rotatably mounted on the front of the base and operates a pair of switches SW1-A and SW1-B (FIG. 7) for selectively supplying power to the fluorescent tube 23 and the bulb 25.

Figure 7:
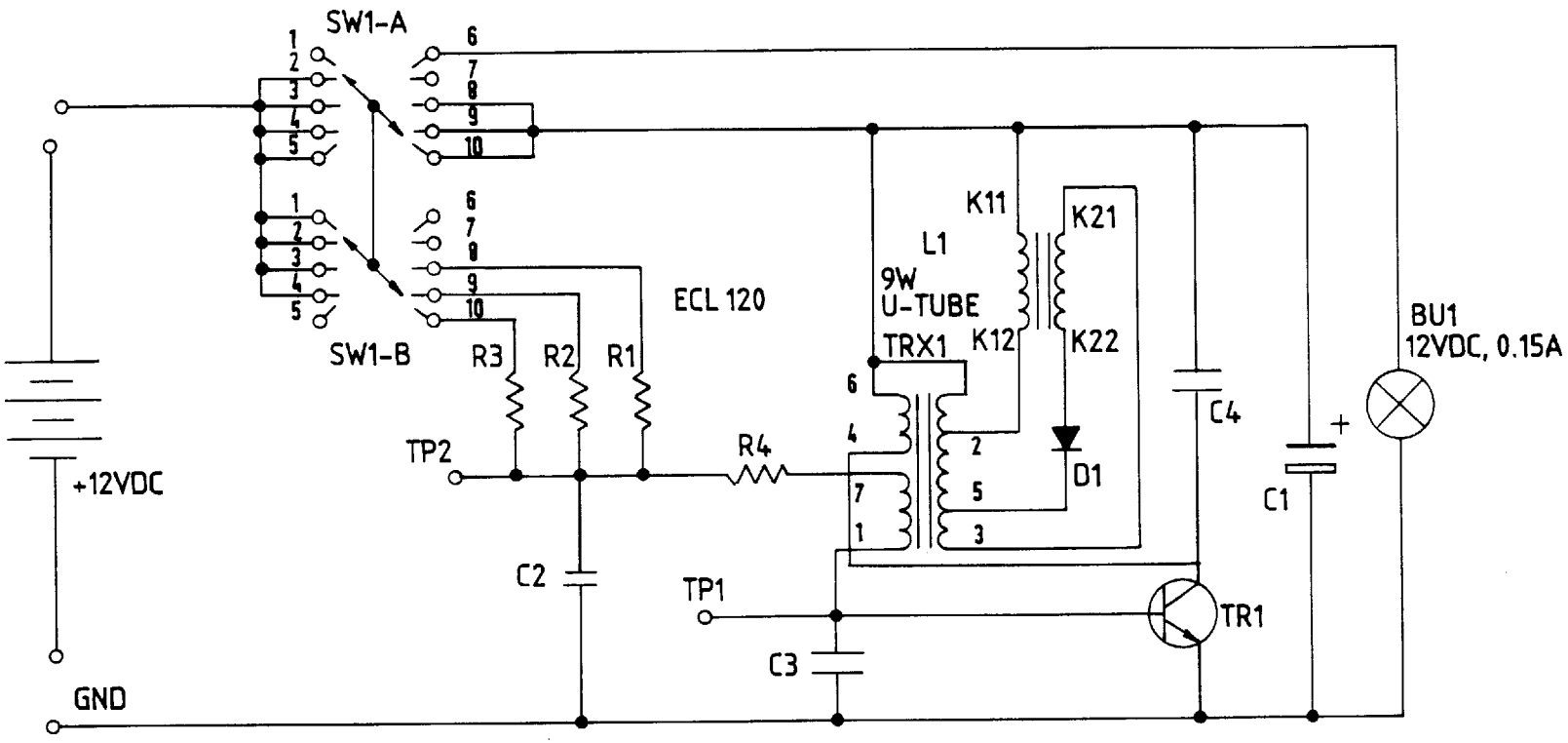
FIG. 7 is a circuit diagram of an exemplary embodiment of the combination lantern of the present invention.

In one exemplary embodiment, the combination lantern is used in conjunction with an electrical circuit such as that shown in FIG. 7, which shows a circuit manufactured by Foster Industries Co., Ltd. of Hong Kong.

The switches SW1-A and SW1-B are moveable by the control knob 30 between a "first" or off position in which both the fluorescent tube light and the incandescent light bulb are off, as would be achieved by setting the pair of switches in the circuit diagram shown in FIG. 7 to the 2–7 positions, a "second" position in which the incandescent light bulb is on and the fluorescent tube light is off, and a "third" position in which the incandescent light is off and the fluorescent tube light is on. If desired, the switch can also have a "fourth" position in which both the fluorescent tube light and the incandescent light bulb are on.

Thus, the combination of the colored lens and angled side panel in which the lens is mounted achieves a dim illumination of a wide area, such as the inside of a tent, thus allowing campers to see at night, but at the same time not disturbing campers who are sleeping.

It will be recognized by those skilled in the art that, although the above description contains many specificities, these should not be construed as limiting the scope of the present invention, but rather as illustrating the presently preferred embodiments of the invention.

I claim:

1. A lantern comprising:

a base, first and second lights mounted on the base, a globe mounted on the base around said lights.

a lens mounted in the base and covering one of said lights, and a switch operable between a first position in which both of said lights are off, a second position in which only one of said lights is on, and a third position in which only the other of said lights is on.

2. The lantern of claim 1, wherein said lens is colored.

3. The lantern of claim 1, wherein the other of said lights is a fluorescent light tube.

4. A lantern comprising:

a base having a bottom and a top wall, the top wall including a central panel and an angled panel which extends outwardly and downwardly from the central panel, a globe mounted on said base, an elongated fluorescent tube light mounted in a socket in said central panel of the base within said globe and extending upwardly from the central panel, a lens mounted in said angled panel, a light bulb mounted in the base below said lens, an electric power source mounted in the base for providing electric power to the fluorescent tube light and the light bulb, and a switch mounted in said base and being operable between a first position in which both of said fluorescent light tube and light bulb are off, a second position in which said fluorescent light tube is on and said light bulb is off, and a third position in which said light bulb is on and said fluorescent light tube is off.

5. The lantern of claim 4, wherein said lens is colored.

6. The lantern of claim 4, wherein said switch is further operable in a fourth position in which both of said fluorescent light tube and light bulb are on.

7. A lantern comprising:

a base having a peripheral sidewall, a bottom and a top wall, the top wall including a central panel and a plurality of angled panels which extend outwardly and downwardly from the central panel, said base having a cavity therein for receiving batteries, a globe mounted on said base, a first socket in the central panel, an elongated fluorescent tube light mounted in the first socket extending upwardly from the base within said globe, a colored lens mounted in said angled panel, a second socket mounted in said angled panel, a light bulb mounted in the second socket below said colored lens, a switch mounted in said peripheral sidewall of the base and being operable between a first position in which both of said fluorescent light tube and light bulb are off, a second position in which said fluorescent light tube is on and said light bulb is off, and a third position in which said light bulb is on and said fluorescent light tube is off.

8. The lantern of claim 7, wherein said switch is further operable in a fourth position in which both of said fluorescent light tube and light bulb are on.

* * * * *